US007287660B2

(12) United States Patent
Ramirez et al.

(10) Patent No.: US 7,287,660 B2
(45) Date of Patent: Oct. 30, 2007

(54) TWO-COMPARTMENT CONTAINER

(75) Inventors: Richard L. Ramirez, Lawrenceville, GA (US); Mark A. Bergeron, Lithonia, GA (US)

(73) Assignee: Tekni-Plex, Inc., Somerville, NJ (US)

( * ) Notice: Subject to any disclaimer, the term of this patent is extended or adjusted under 35 U.S.C. 154(b) by 513 days.

(21) Appl. No.: 10/802,416

(22) Filed: Mar. 16, 2004

(65) Prior Publication Data

US 2005/0205570 A1 Sep. 22, 2005

(51) Int. Cl.
*B65D 1/36* (2006.01)

(52) U.S. Cl. ..... 220/4.23; 220/4.22; 220/4.26; 220/520; 206/561

(58) Field of Classification Search ..... 220/556, 220/524, 520, 553, 554, 555, 557, 4.22, 4.23, 220/4.26, 5.26, 575
See application file for complete search history.

(56) References Cited

U.S. PATENT DOCUMENTS 3,184,133 A * 5/1965 Boyd et al. ..... 206/521.1
3,595,425 A * 7/1971 Eicholtz et al. ..... 220/556
3,633,785 A * 1/1972 Cyr et al. ..... 220/556
4,653,685 A * 3/1987 Leary et al. ..... 229/406
5,094,355 A * 3/1992 Clark et al. ..... 220/4.23
5,947,321 A * 9/1999 Vadney ..... 220/367.1
2005/0000966 A1* 1/2005 Nordland et al. ..... 220/367.1

* cited by examiner

*Primary Examiner*—Anthony Stashick
*Assistant Examiner*—Christopher McKinley
(74) *Attorney, Agent, or Firm*—Day Pitney LLP

(57) ABSTRACT

A two-compartment container has a lid portion and a base portion hingedly connected to one another and openable and closable in the manner of a clamshell. Both the lid portion and the base portion have partitions, which extend from the hinge and which are aligned with one another. When the container is closed, the partitions abut against one another, effectively isolating the two compartments formed in the base portion by its partition from one another. The base portion includes a locking flap which fits into a gap between the partition in the lid portion and its face and seals it to further isolate the two compartments from one another.

22 Claims, 7 Drawing Sheets

TWO-COMPARTMENT CONTAINER

BACKGROUND OF THE INVENTION

1. Field of the Invention

The present invention relates to the packaging arts. More particularly, the present invention relates to the containers, often made of foamed or solid (unfoamed) polystyrene sheet material, in which food, especially that intended to be purchased at a restaurant or similar establishment and consumed off-premises, is packaged.

2. Description of the Prior Art

The prior art is replete with examples of containers of the subject type. For example, U.S. Pat. No. 4,915,251 to Payne discloses a thermoformed plastic carton constructed from two half sections which are integrally connected along one side by a hingable joint to allow the half sections to be folded upon each other. The carton also includes resiliently deflectable latches extending up from an edge of one carton half which each mate with and become lodged in a receptacle in the other carton half section when the carton half sections are folded one upon another.

One of the two half sections, the base, is formed with one or more compartments for receiving food. As illustrated in the patent, the base has three such compartments. The lid, that is, the other of the two half sections, has no compartments. Clearly, when the carton is closed, the three compartments, each possibly having a different food item, are not isolated from one another. As a consequence, a warm item in one of the compartments will lose heat to the entire interior of the closed carton. This may not present a problem unless an item in another compartment, such as a salad, is better when kept cold.

In view of the above, there has been a need for a multi-compartment container having compartments which are isolated from one another when the container is closed. That need is met by the present invention.

SUMMARY OF THE INVENTION

Accordingly, the present invention is a two-compartment container having a lid portion and a base portion. The lid portion is hingedly connected to the base portion by a hinge, and is thereby openable and closable relative to the base portion in the manner of a clamshell.

The base portion has a base partition extending across the base portion in a direction substantially transverse to the hinge and dividing the base portion into a first compartment and a second compartment. The base portion also has a locking flap opposite to the hinge.

The lid portion has a lid partition extending across the lid portion in a direction substantially transverse to the hinge. The lid partition is aligned with the base partition so as to abut against the base partition when the two-compartment container is closed. The lid partition is separated from a face of the lid portion opposite to the hinge by a gap. When the lid portion is closed onto the base portion, the locking flap on the base portion fits into the gap in the lid portion. The locking flap and the face of the lid portion together have cooperative means for maintaining the two-compartment container in a closed condition.

When the lid portion is closed onto the base portion, the lid partition and the base partition, which align with one another as stated above, abut against one another and effectively isolate the first compartment from the second compartment. To complete this isolation, the locking flap includes a wedge which fits into the gap in the lid portion, and, above the wedge, an arcuate portion which presses into the top of the gap, the wedge and the arcuate portion together closing the gap when the lid portion is closed and locked onto the base portion to prevent any communication between the first compartment and the second compartment.

The present invention will now be described in more complete detail with frequent reference being made to the several drawing figures identified below.

DETAILED DESCRIPTION OF THE PREFERRED EMBODIMENTS

Figure 1:
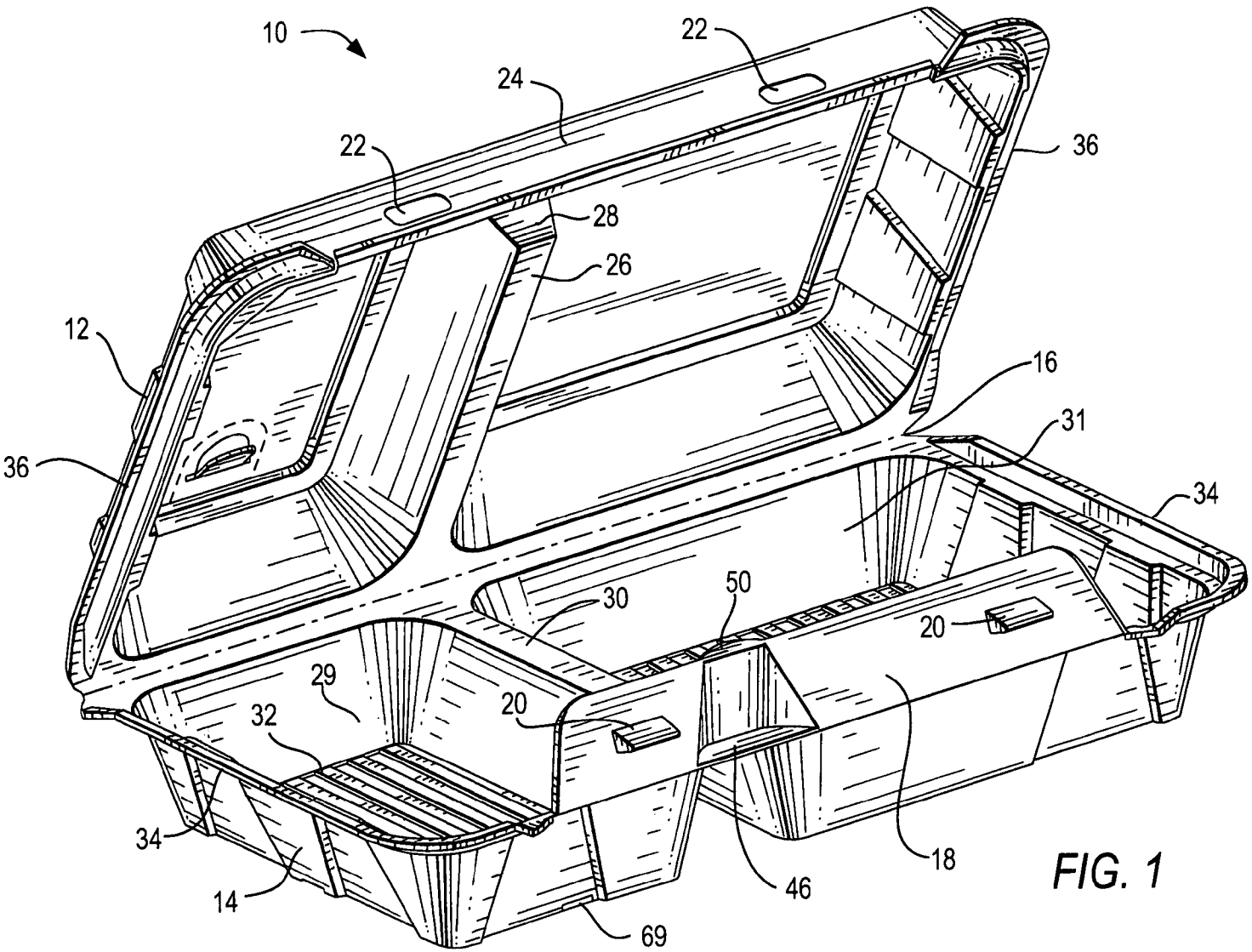
FIG. 1 is a perspective view of the two-compartment container of the present invention in a partially opened condition.

Turning now to consider these figures in greater detail, FIG. 1 is a perspective view of a two-compartment container 10 of the present invention in a partially opened condition. The container 10 comprises a lid portion 12 and a base portion 14, the two portions 12, 14 being hingedly connected to one another at hinge 16 and being openable and closable in the manner of a clamshell. The base portion 14 has a locking flap 18 opposite to the hinge 16. The locking flap 18 includes nubs 20 which enable the container 10 to maintain a closed condition by protruding through holes 22 in the face 24 of the lid portion 12 when the lid portion 12 is closed down onto the base portion 14. Locking flap 18 is also hingedly connected to the base portion 14 so that it may be pushed inside the lid portion 12, when the latter is closed down onto the base portion 14, to ensure that the nubs 20 engage with their respective holes 22 to maintain the container 10 in a closed condition. When in that condition, the container 10 may be opened by pressing in on the nubs 20 from the outside of the container 10 to release them from the holes 22 and to allow the lid portion 12 to pop open. Alternatively, the container 10 may be opened with one hand by inserting a finger between face 24 of the lid portion 12 and the wedge 46 of the locking flap 18, releasing the nubs 20 from the holes 22 and allowing the lid portion 12 to pop open.

The lid portion 12 has a partition 26 which extends thereacross from the hinge 16 to a point separated from the face 24 leaving a gap 28, so that the locking flap 18 may fit between face 24 and partition 26 when the container 10 is closed.

In a similar manner, the base portion 14 has a partition 30 which extends completely thereacross forming two compartments 29, 31 therein. Partitions 26, 30 are aligned with one another in order to enable two separate compartments 29, 31 to be isolated from one another when the lid portion 12 is closed down onto the base portion 14, the gap 28 being closed in a manner to be described below. Nubs 20 and holes 22 are positioned so that lid portion 12 is under tension toward base portion 14 when container 10 is closed, thereby pressing partitions 26, 30 together to enable compartments 29, 31 to be isolated from one another.

The bottom of the compartments 29, 31 in the base portion 14 may have a plurality of channels 32 to collect liquid which may drain or seep from food placed therein on either side of partition 30.

Except for the area of the hinge 16 and the locking flap 18, the base portion 14 has a stepped edge 34. In like manner, the lid portion 12 has a correspondingly stepped edge 36, so that stepped edge 36 fits into stepped edge 34 when the lid portion 12 is closed down onto the base portion 14 to seal the interior of the container 10 from the outside. The stepped edges 34, 36 need not be shaped exactly as shown—those of ordinary skill in the art will recognize that many corresponding and interlocking or intermeshing shapes may be used in the practice of the present invention.

Figure 2:
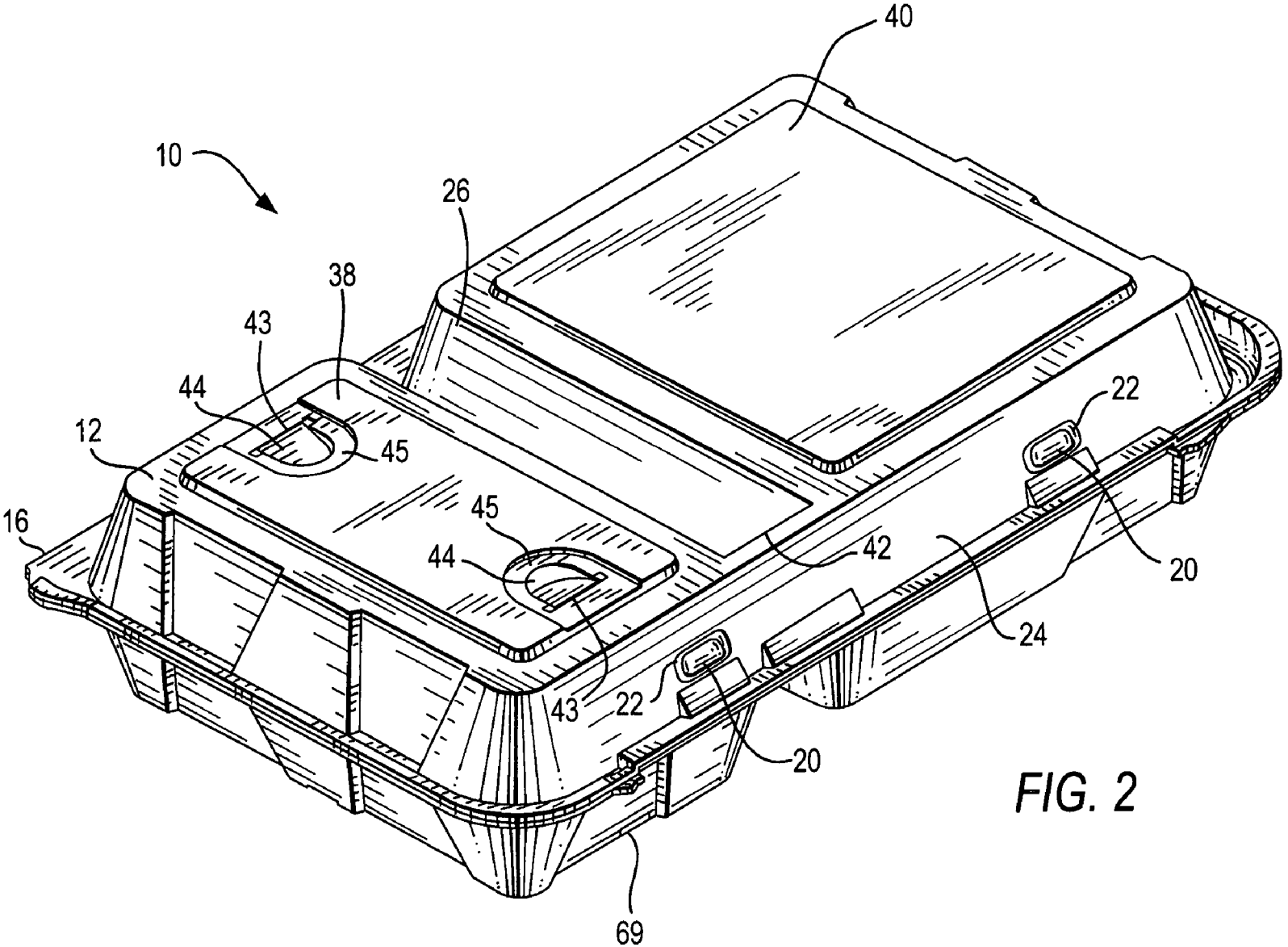
FIG. 2 is a perspective view of the container in a closed condition.

FIG. 2 is a perspective view of the two-compartment container 10 in a closed condition. The lid portion 12 includes a top surface divided into a first region 38 and a second region 40, these covering the two compartments 29, 31 formed by partition 30 within the bottom portion 14 of the container 10. As noted above, partition 26 of lid portion 12 does not extend completely to the face 24 of the lid portion 12, providing a gap 28 into which the locking flap 18 fits when the container 10 is closed. The gap 28 is evidenced by the bridge 42 connecting the first and second regions 38, 40.

The first region 38 of the top surface of the lid portion 12 has two vents 44, formed by perforations, in the form of flaps. The vents 44 are provided to enable heat and steam to escape from hot food disposed in compartment 29 below, and to keep them from entering compartment 31. Vents 44 have hinges 43 and may be kept closed or opened to any desired degree. Further, vents 44 are in recessed areas 45 which are below the plane of the first region 38 of the top surface of the lid portion 12, for a reason to be given below.

Figure 3:
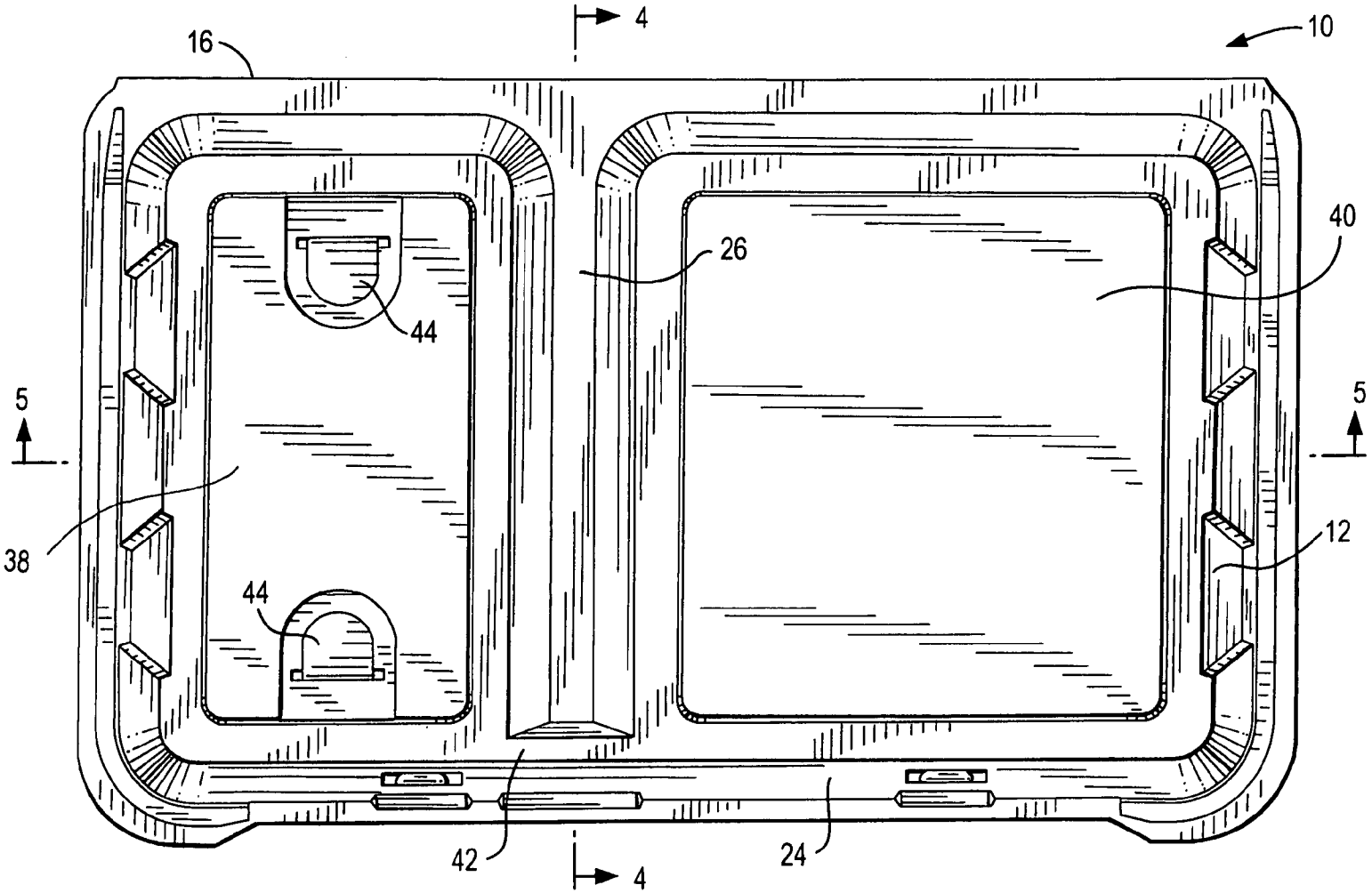
FIG. 3 is a plan view of the top of the closed container shown in FIG. 2.
Figure 4:
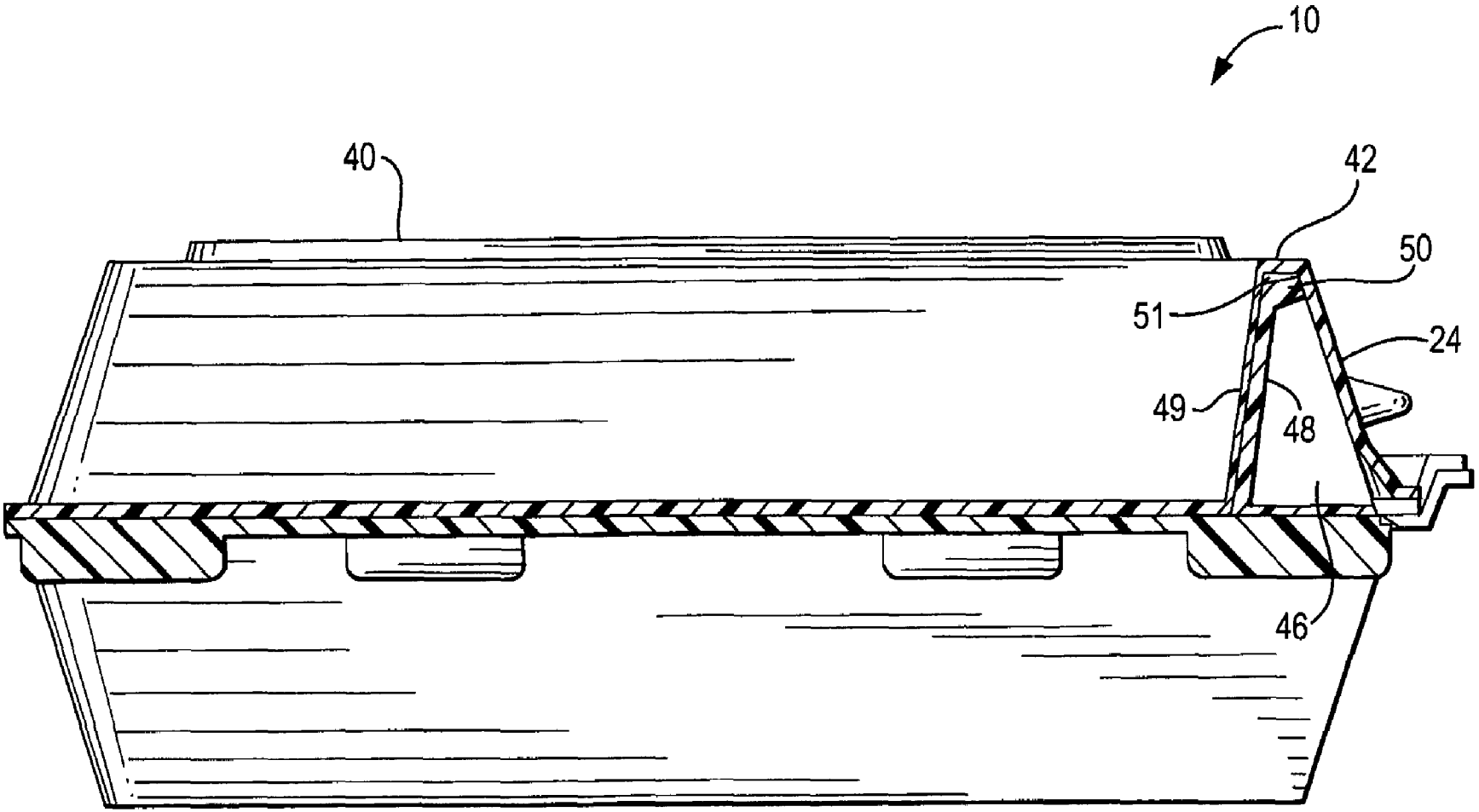
FIG. 4 is a cross-sectional view taken as indicated in FIG. 3.
Figure 5:
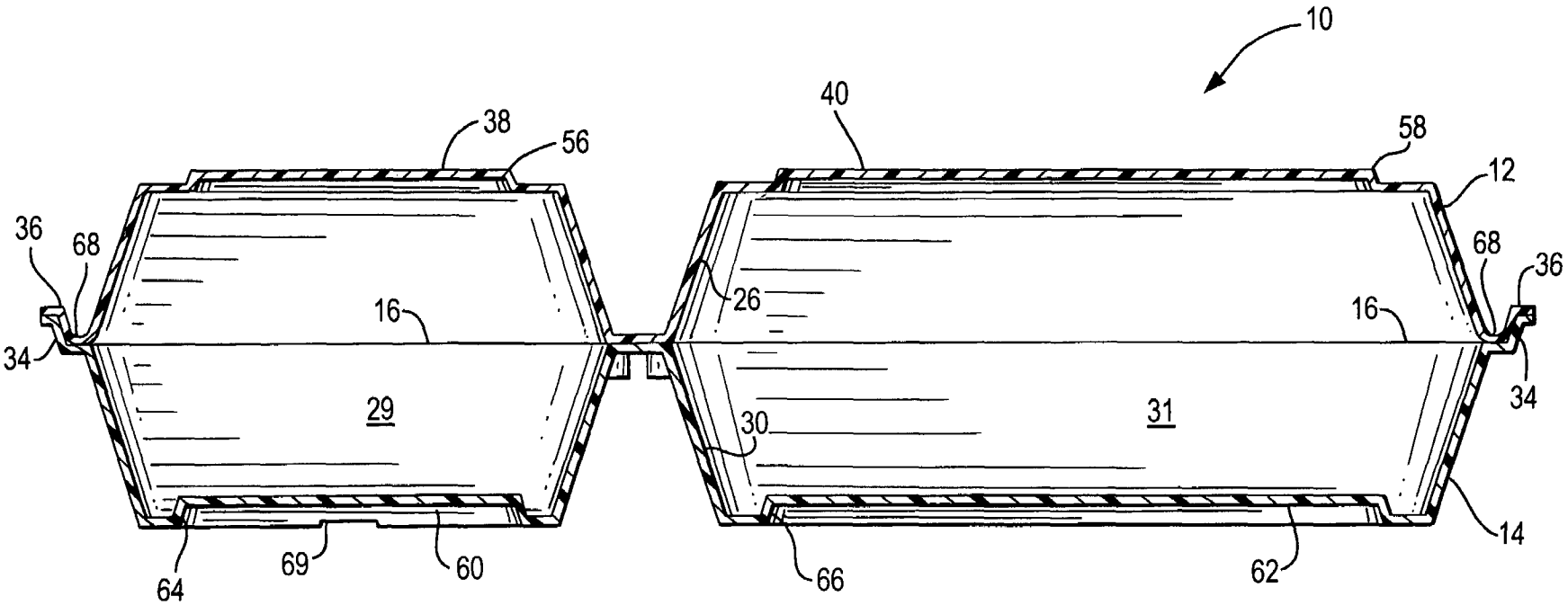
FIG. 5 is a cross-sectional view taken as indicated in FIG. 3.

FIG. 3 is a plan view of the top surface of the closed container 10, and FIGS. 4 and 5 are cross-sectional views taken as indicated in FIG. 3. Turning first to FIG. 4, a cross section taken longitudinally along the partition 26 separating the first and second regions 38, 40 and through the bridge 42 separating them, locking flap 18 includes a wedge 46, which is also visible in FIG. 1. Wedge 46 seals the two compartments 29, 31 formed by partition 30 within the container 10 from one another by closing gap 28 between partition 26 and face 24 of lid portion 12. In particular, wedge 46 has an inner surface 48 which abuts the end surface 49 of partition 26 to close off the space which would otherwise allow communication between the two compartments 29, 31. It should be noted that the arcuate portion 50 above the wedge 46 deforms the inside surface 51 of bridge 42, when the container 10 is closed, to ensure that compartment 29 is isolated from compartment 31. It should be noted in FIG. 4 that the inner surface 48 and arcuate portion 50 of wedge 46 are thicker than end surface 49 of lid partition 26 and inside surface 51 of bridge 42 in order that the wedge 46 be readily insertable into gap 28 against resilient end surface 49 and arcuate portion 50 may readily deform inside surface 51 of bridge 42. Moreover, the locking flap 18, being itself as thick as wedge 46 and substantially as high as the inside of the face 24 of the lid portion 12, stabilizes and supports the lid portion 12 when the container 10 is closed.

Turning now to FIG. 5, a cross section taken across the container 10 and transversely through partition 26 as shown in FIG. 3, partitions 26, 30 meet and abut one another when lid portion 12 is closed onto base portion 14 to separate two compartments 29, 31 from one another. In addition, the first and second regions 38, 40 of the top surface of the lid portion 12 have raised areas 56, 58. Similarly, the base portion 14 has a bottom surface which includes first and second regions 60, 62. These latter regions 60, 62 have indented areas 64, 66 of the same size as the respective raised areas 56, 58. This inhibits the sliding of containers 10 upon one another when they are stacked.

Moreover, still referring to FIG. 5, the indented area 64 of first region 60 of bottom surface of base portion 14 has two channels 69, one in the rear visible in FIG. 5, and the other visible in FIGS. 1 and 2, to permit heat and steam to escape from vents 44 when containers 10 are stacked upon one another. In such a situation, channels 69 communicate with recessed areas 45 of a container 10 stacked below to permit heat and steam to exit therefrom.

As noted above, base portion 14 has a stepped edge 34 and lid portion 12 has a stepped edge 36. As shown in FIG. 5, stepped edges 34, 36 cooperate with one another to seal the perimeter of the closed two-compartment container 10, except in the areas of the hinge 16 and locking flap 18. Stepped edged 36, having substantially the same shape as stepped edge 38, fits above and inside stepped edge 38 when the container 10 is closed to seal its perimeter. Channel 68 separates stepped edge 36 from the rest of the lid portion 12.

Figure 6:
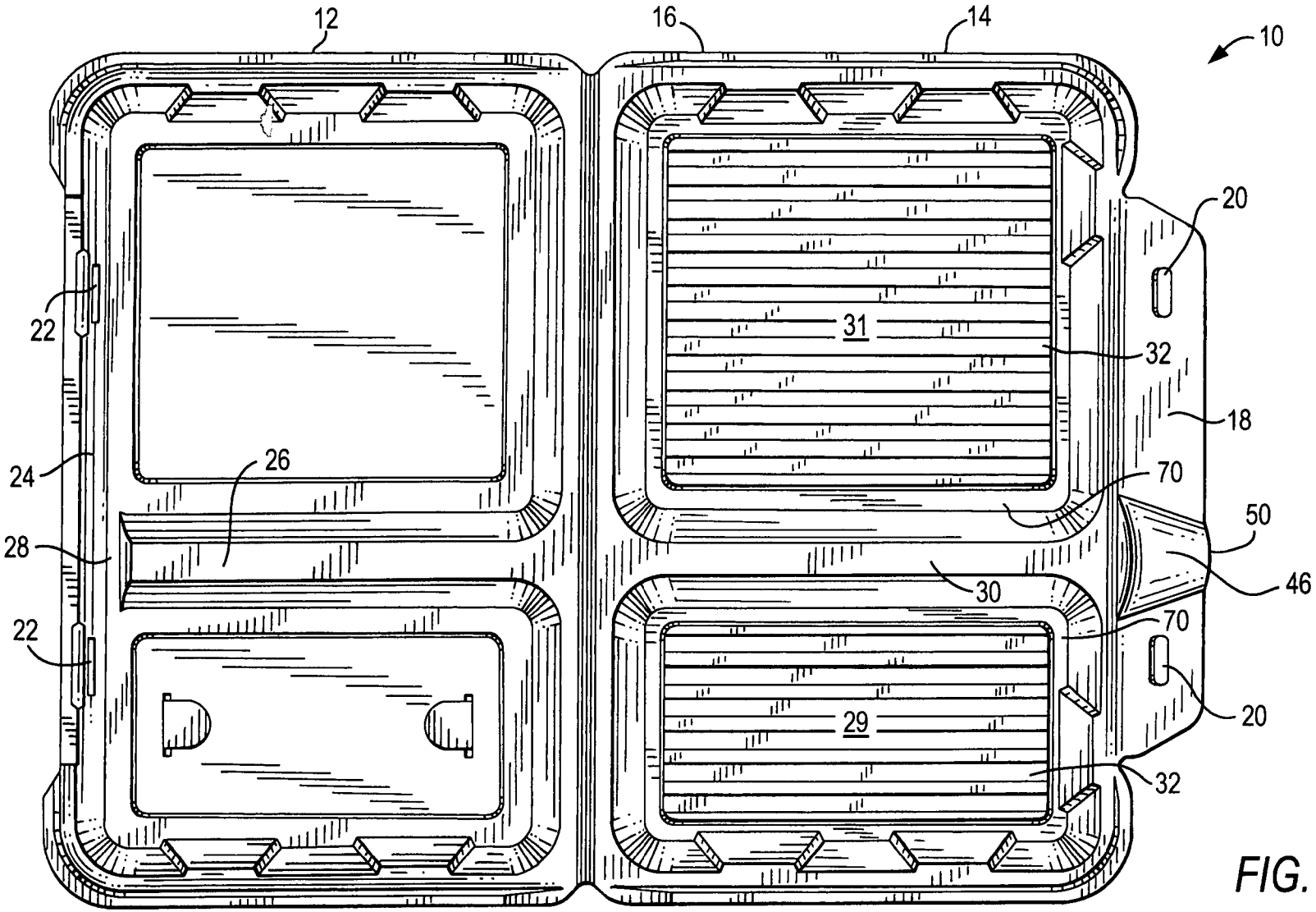
FIG. 6 is a plan view of the inside of a fully opened container.

FIG. 6 is a plan view of the inside of a fully opened two-compartment container 10. Referring first to the lid portion 12, holes 22 are provided in the face 24 thereof for the nubs 20 provided on locking flap 18. Partition 26 is separated from face 24 by a gap 28 so that the wedge 46 may fit into the gap 28 when the container 10 is closed.

Referring to base portion 14, the bottom of each compartment 29, 31 has a plurality of channels 32 to collect liquid which drains or seeps from food placed therein on either side of partition 30. A channel 70 runs around the perimeter of the bottom of each compartment 29, 31, and is slightly lower than the plurality of channels 32 so that liquid accumulating in channels 32 may flow into channel 70.

Figure 7:
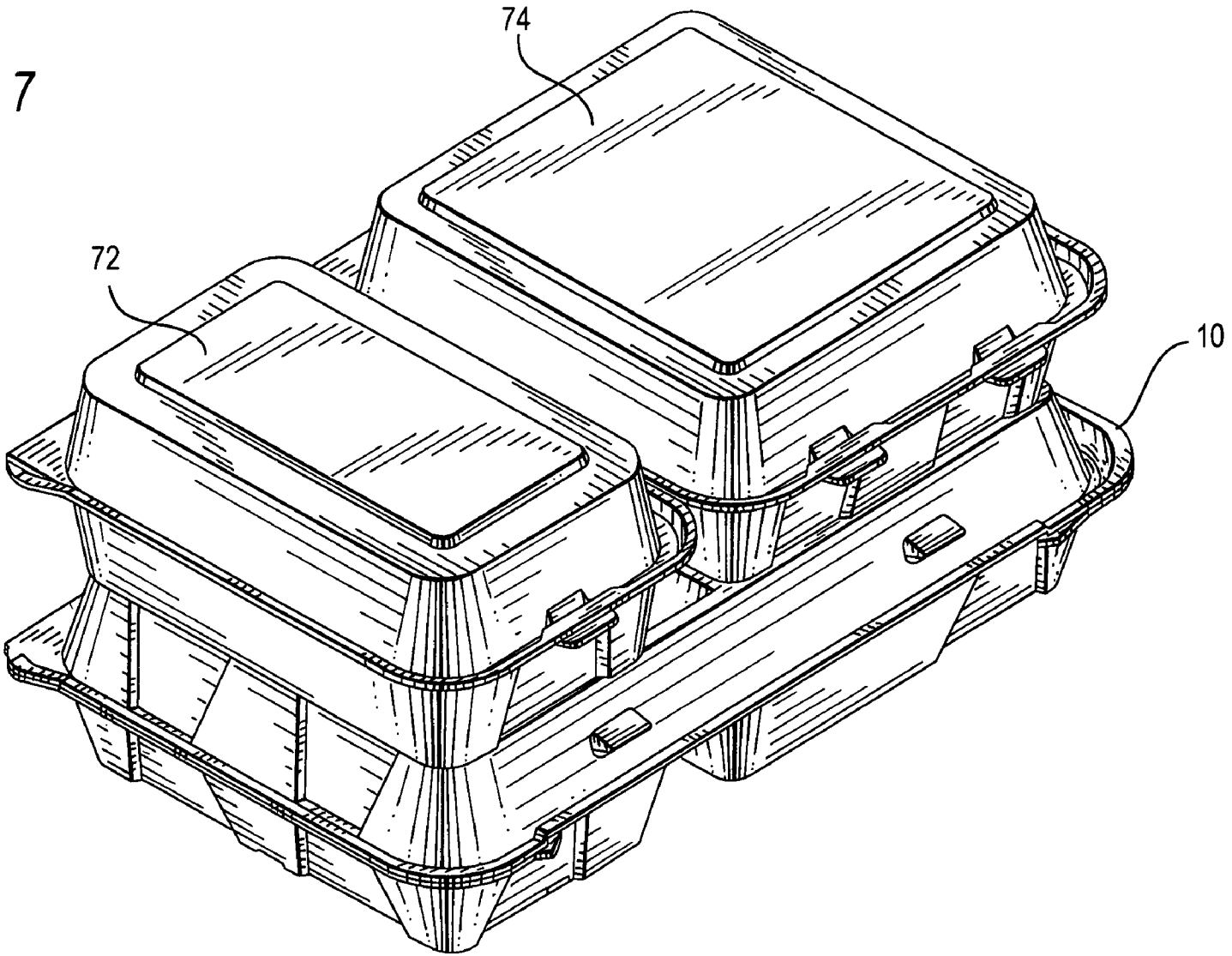
FIG. 7 is a perspective view of the container supporting two additional containers.

FIG. 7 is a perspective view of the two-compartment container 10 with additional containers 72, 74, sized to fit atop the first and second regions 38, 40 of the lid portion 12 of container 10, stacked thereon to illustrate a benefit of the container 10, namely, that its sturdy construction, reinforced by the locking flap 18, enables it to be used in the illustrated manner by customers who have purchased food items from vendors using the container 10. Preferably, the bottom of container 72 has an indented area like indented area 64 of first region 60 of bottom surface of base portion 14 of container 10 to enable container 72 to sit upon raised area 56 of first region 38 of the top surface of container 10 without sliding. Similarly, the bottom of container 74 preferably has an indented area like indented area 66 of second region 62 of bottom surface of base portion 14 of container 10 to enable container 74 to sit upon raised area 58 of second region 40 of the top surface of container 10 without sliding.

The two-compartment container 10 of the present invention is preferably formed by molding plastic sheet material, either foamed or solid (unfoamed), such as polystyrene sheet material.

Modifications to the above would be obvious to those of ordinary skill in the art, but would not bring the two-compartment container 10 so modified beyond the scope of the appended claims.

What is claimed is:

1. A two-compartment container comprising a lid portion and a base portion, said lid portion being hingedly connected to said base portion by a hinge, thereby being openable and closable relative to said base portion in the manner of a clamshell, said base portion having a base partition extending across said base portion in a direction substantially transverse to said hinge and dividing said base portion into a first compartment and a second compartment, said base portion further having a locking flap opposite to said hinge, said base partition extending from said hinge to said locking flap, and said lid portion having a lid partition extending across said lid portion in a direction substantially transverse to said hinge, said lid partition extending from said hinge toward a face of said lid portion opposite to said hinge and being aligned with said base partition so as to abut against said base partition when said two-compartment container is closed, said lid partition being separated from said face of said lid portion opposite to said hinge by a gap, said locking flap on said base portion fitting into said gap in said lid portion when said lid portion is closed onto said base portion, wherein said locking flap comprises a wedge, said wedge being aligned with said gap in said lid portion, so that said wedge fits tightly in said gap when said locking flap fits into said gap in said lid portion when said lid portion is closed onto said base portion, said wedge thereby isolating said first compartment from said second compartment, said locking flap and said face of said lid portion together having cooperative means for maintaining said two-compartment container in a closed condition.

2. A two-compartment container as claimed in claim 1 wherein said means for maintaining said two compartment container in a closed condition comprises at least one nub on said locking flap and at least one hole through said face of said lid portion, said at least one nub and said at least one hole being aligned with one another whereby said at least one nub engages with said at least one hole when said locking flap fits into said gap in said lid portion when said lid portion is closed onto said base portion to place said lid portion under tension toward said base portion.

3. A two-compartment container as claimed in claim 1 wherein said wedge has an inner surface, said inner surface abutting said lid partition when said locking flap fits into said gap in said lid portion.

4. A two-compartment container as claimed in claim 1 wherein said locking flap further comprises an arcuate portion outward of said wedge, said arcuate portion deforming an inside surface of said gap when said locking flap fits into said gap in said lid portion to further isolate said first compartment from said second compartment.

5. A two-compartment container as claimed in claim 1 wherein at least one of said first and second compartments has a bottom having a plurality of channels to collect liquid.

6. A two-compartment container as claimed in claim 5 wherein said bottom further comprises a perimeter channel running around the perimeter thereof, said perimeter channel being provided to collect liquid draining from said plurality of channels.

7. A two-compartment container as claimed in claim 1 wherein said base portion has a stepped edge exclusive of said hinge and said locking flap, and said lid portion has a correspondingly stepped edge so that said stepped edge of one of said base portion and said lid portion fits into said stepped edge of the other of said base portion and lid portion when said lid portion is closed down onto said base portion.

8. A two-compartment container as claimed in claim 7 wherein said stepped edge of said lid portion and said stepped edge of said base portion have substantially the same shape.

9. A two-compartment container as claimed in claim 7 wherein said stepped edge of one of said lid portion and base portion is separated from its respective portion by a channel.

10. A two-compartment container as claimed in claim 1 wherein said lid portion includes a top surface having a first region over said first compartment and a second region over said second compartment, at least one of said first and second regions having at least one vent to enable heat and steam to escape from at least one of said first and second compartments.

11. A two-compartment container as claimed in claim 10 wherein said vent has a hinge whereby said vent may be closed or opened to any desired degree.

12. A two-compartment container as claimed in claim 10 wherein said vent is in a recessed area in at least one of said first and second regions.

13. A two-compartment container as claimed in claim 1 wherein said locking flap is substantially as high as said face of said lid portion to stabilize and support said lid portion when said two-compartment container is closed.

14. A two-compartment container as claimed in claim 13 wherein said locking flap is thicker than said face of said lid portion.

15. A two-compartment container as claimed in claim 1 wherein said lid portion includes a top surface having a first region over said first compartment and a second region over said second compartment, and a bottom surface having a first region under said first compartment and a second region under said second compartment, said first and second regions on said top surface having raised areas and said first and second regions on said bottom surface having correspondingly indented areas, so that said two-compartment container may be stacked without sliding upon one another.

16. A two-compartment container as claimed in claim 15 wherein said indented area in at least one of said first and second regions on said bottom surface of said base portion has at least one channel to allow heat and steam to escape from a vent in a container stacked below.

17. A two-compartment container as claimed in claim 1 wherein said two-compartment container is formed by molding plastic sheet material.

18. A two-compartment container as claimed in claim 17 wherein said plastic sheet material is foamed.

19. A two-compartment container as claimed in claim 17 wherein said plastic sheet material is unfoamed.

20. A two-compartment container as claimed in claim 17 wherein said plastic sheet material is polystyrene sheet material.

21. A two-compartment container as claimed in claim 20 wherein said polystyrene sheet material is foamed.

22. A two-compartment container as claimed in claim 20 wherein said polystyrene sheet material is unfoamed.

* * * * *